US010704361B2

(12) United States Patent
Mailand et al.

(10) Patent No.: US 10,704,361 B2
(45) **Date of Patent: *Jul. 7, 2020**

(54) METHOD AND APPARATUS FOR INJECTING FLUID INTO SPACED INJECTION ZONES IN AN OIL/GAS WELL

(71) Applicant: Tejas Research & Engineering, LLC, The Woodlands, TX (US)

(72) Inventors: Jason C. Mailand, The Woodlands, TX (US); Thomas G. Hill, Jr., Conroe, TX (US)

(73) Assignee: TEJAS RESEARCH & ENGINEERING, LLC, The Woodlands, TX (US)

( * ) Notice: Subject to any disclaimer, the term of this patent is extended or adjusted under 35 U.S.C. 154(b) by 82 days.

This patent is subject to a terminal disclaimer.

(21) Appl. No.: 16/012,895

(22) Filed: Jun. 20, 2018

(65) Prior Publication Data

US 2018/0298726 A1 Oct. 18, 2018

Related U.S. Application Data

(63) Continuation-in-part of application No. 15/192,787, filed on Jun. 24, 2016, now Pat. No. 10,018,022, (Continued)

(51) Int. Cl.
*E21B 34/10* (2006.01)
*E21B 43/25* (2006.01)
(Continued)

(52) U.S. Cl.
CPC ..... *E21B 34/10* (2013.01); *E21B 34/102* (2013.01); *E21B 34/14* (2013.01);
(Continued)

(58) Field of Classification Search
CPC .... E21B 43/14; E21B 43/255; E21B 41/0078; E21B 34/14; E21B 34/102; E21B 2034/005
See application file for complete search history.

(56) References Cited

U.S. PATENT DOCUMENTS 3,724,475 A 4/1973 Ruppel
3,973,587 A 8/1976 Cochran
(Continued)

FOREIGN PATENT DOCUMENTS

AU 2013251422 B 8/2017
EP 2841685 B1 7/2017

OTHER PUBLICATIONS

European search report and European search opinion for European application ser. No. 13781010.7, a national phase entry of PCT/US2013/038438, dated Nov. 26, 2015.
(Continued)

*Primary Examiner* — Michael R Wills, III
(74) *Attorney, Agent, or Firm* — Basil M. Angelo; Angelo IP

(57) ABSTRACT

An injection sleeve and apparatus for injecting fluid into a well includes a flow tube having a piston which upon fluid flow opens one or more outlet ports. The injection sleeve is adapted to include a variable orifice insert which prevents flow through the tool at a first selected pressure level until the outlet ports are in an open position, thereby protecting packing seals on either side of the outlet ports from undue wear and tear, and prolonging the life of the tool. At a second pressure level, the variable orifice insert permits flow through injection sleeve to the formation injection zones. A plurality of the sleeves may be used for sequentially injecting fluid into a plurality of injection formation zones surrounding a well. When injection fluid flow is terminated, the
(Continued)

injection sleeves act as a dual barrier valve for preventing flow from the injection formation zones back to the well head.

3 Claims, 8 Drawing Sheets

Related U.S. Application Data which is a continuation-in-part of application No. 14/697,289, filed on Apr. 27, 2015, now Pat. No. 9,523,260, which is a continuation-in-part of application No. 13/863,063, filed on Apr. 15, 2013, now Pat. No. 9,217,312, which is a continuation-in-part of application No. 13/669,059, filed on Nov. 5, 2012, now Pat. No. 9,334,709.

(60) Provisional application No. 61/639,569, filed on Apr. 27, 2012.

(51) Int. Cl.

| | |
|---|---|
| ***E21B 41/00*** | (2006.01) |
| ***E21B 34/14*** | (2006.01) |
| *E21B 43/14* | (2006.01) |
| *E21B 34/00* | (2006.01) |

(52) U.S. Cl.

CPC ..... *E21B 41/0078* (2013.01); *E21B 43/255* (2013.01); *E21B 43/14* (2013.01); *E21B 2034/007* (2013.01)

(56) References Cited

U.S. PATENT DOCUMENTS

| | | | |
|---|---|---|---|
| 4,069,871 | A | 1/1978 | Page, Jr. |
| 4,069,874 | A | 1/1978 | Buck et al. |
| 4,137,933 | A | 2/1979 | Culpepper |
| 4,362,214 | A | 12/1982 | Pringle et al. |
| 4,362,215 | A | 12/1982 | Sparks |
| 4,416,301 | A | 11/1983 | Brumm |
| 4,585,067 | A | 4/1986 | Blizzard et al. |
| 4,601,342 | A | 7/1986 | Pringle |
| 4,624,315 | A | 11/1986 | Dickson et al. |
| 5,004,007 | A | 4/1991 | Johnson et al. |
| 5,095,994 | A | 3/1992 | Dollison |
| 5,190,106 | A | 3/1993 | Johnston |
| 6,241,022 | B1 | 6/2001 | Mailand et al. |
| 6,315,047 | B1 | 11/2001 | Deaton et al. |
| 6,415,509 | B1 | 7/2002 | Echols et al. |
| 6,514,408 | B1 | 2/2003 | Simone |
| 6,799,686 | B2 | 10/2004 | Echols et al. |
| 6,971,405 | B2 | 12/2005 | Pickelman |
| 7,287,684 | B2 | 10/2007 | Blackburne, Jr. |
| 7,571,773 | B1 | 8/2009 | West et al. |
| 7,578,344 | B2 | 8/2009 | Hopkins et al. |
| 7,614,452 | B2 | 11/2009 | Kenison et al. |
| 7,631,664 | B1 | 12/2009 | Mailand |
| 7,694,740 | B2 | 4/2010 | Mailand et al. |
| 7,703,532 | B2 | 4/2010 | O'Malley et al. |
| 7,712,537 | B2 | 5/2010 | Hill et al. |
| 7,735,557 | B2 | 6/2010 | Mailand et al. |
| 7,814,982 | B2 | 10/2010 | Moyes |
| 7,841,416 | B2 | 11/2010 | Henschel et al. |
| 7,854,268 | B2 | 12/2010 | Lehr et al. |
| 7,866,401 | B2 | 1/2011 | McCalvin |
| 7,918,280 | B2 | 4/2011 | Mailand et al. |
| 7,963,334 | B2 | 6/2011 | Hill et al. |
| 7,980,303 | B2 | 7/2011 | Hill, Jr. et al. |
| 8,316,944 | B2 | 11/2012 | Pringle et al. |
| 8,356,753 | B2 | 1/2013 | Chiou et al. |
| 8,365,753 | B2 | 2/2013 | Dana |
| 8,555,960 | B2 | 10/2013 | Mailand et al. |
| 8,579,024 | B2 | 11/2013 | Mailand et al. |
| 8,668,014 | B2 | 3/2014 | Mailand |
| 8,910,717 | B2 | 12/2014 | Mailand et al. |
| 8,960,298 | B2 | 2/2015 | Hill, Jr. et al. |
| 9,068,429 | B2 | 6/2015 | Mailand et al. |
| 9,103,184 | B2 | 8/2015 | Hill, Jr. et al. |
| 9,133,688 | B2 | 9/2015 | Jancha et al. |
| 9,212,547 | B2 | 12/2015 | Miller et al. |
| 9,217,312 | B2 | 12/2015 | Hill, Jr. et al. |
| 9,260,961 | B2 | 2/2016 | Miller et al. |
| 9,334,709 | B2 | 5/2016 | Hill, Jr. et al. |
| 9,359,865 | B2 | 6/2016 | Mailand et al. |
| 9,359,887 | B2 | 6/2016 | Miller et al. |
| RE46,137 | E | 9/2016 | Jason et al. |
| 9,441,456 | B2 | 9/2016 | Hill, Jr. et al. |
| 9,518,440 | B2 | 12/2016 | Sanchez et al. |
| 9,523,260 | B2 | 12/2016 | Mailand et al. |
| 9,593,560 | B2 | 3/2017 | Mailand et al. |
| 9,624,755 | B2 | 4/2017 | Hill, Jr. et al. |
| 9,638,006 | B2 | 5/2017 | Henschel et al. |
| 9,650,857 | B2 | 5/2017 | Mailand et al. |
| 9,677,379 | B2 | 6/2017 | Mailand |
| 9,771,777 | B2 | 9/2017 | Hill, Jr. et al. |
| 9,810,036 | B2 | 11/2017 | Mailand et al. |
| 9,816,350 | B2 | 11/2017 | Mailand et al. |
| 9,920,593 | B2 | 3/2018 | Mailand et al. |
| 10,018,022 | B2 | 7/2018 | Mailand et al. |
| 10,030,476 | B2 | 7/2018 | Hill et al. |
| 10,053,936 | B2 | 8/2018 | Herod et al. |
| 10,100,611 | B2 | 10/2018 | Hill, Jr. et al. |
| 10,119,375 | B1 | 11/2018 | Hill, Jr. |
| 2006/0162932 | A1 | 7/2006 | McCalvin |
| 2006/0278395 | A1 | 12/2006 | Kenison et al. |
| 2007/0256834 | A1 | 11/2007 | Hopkins et al. |
| 2008/0236842 | A1 | 10/2008 | Bhavsar et al. |
| 2009/0065215 | A1 | 3/2009 | Tveiten et al. |
| 2009/0071654 | A1 | 3/2009 | O'Malley et al. |
| 2012/0312540 | A1 | 12/2012 | Lefebvre |
| 2013/0081824 | A1 | 4/2013 | Hill, Jr. et al. |
| 2013/0220624 | A1 | 8/2013 | Hill, Jr. et al. |
| 2015/0204163 | A1 | 7/2015 | Hill et al. |
| 2018/0298726 | A1 | 10/2018 | Mailand et al. |
| 2018/0313189 | A1 | 11/2018 | Hill, Jr. et al. |

OTHER PUBLICATIONS

European search report and European search opinion for European application ser. No. 16784115.4, national phase entry of PCT/US2016/029349 dated Sep. 4, 2018.

Extended European search report for European application ser. No. 16784115.4, a national phase entry of PCT/US2016/029349, dated Sep. 21, 2018.

International search report of the international search authority for PCT international application No. PCT/US2013/038438 dated Aug. 16, 2013.

International search report of the international search authority for PCT international application ser. No. PCT/US2016/029349 dated Oct. 4, 2016.

IP Australia notice of allowance for Australian application No. 2013251422 dated Aug. 15, 2017.

IP Australia patent examination report No. 1 for Australian application No. 2013251422 dated Aug. 25, 2016.

Schlumberger, A-Series Injection Valves, copyright 2009, pp. 1-2, obtained from unknown URL.

Schlumberger, TRTO Series Injection Safety Valves, copyright 2009, pp. 1-2, obtained from URL https://www.slb.com/~/media/Files/completions/product_sheets/safety_valves/trto_sisv.pdf on Dec. 27, 2018.

Written opinion of the international search authority for PCT international application No. PCT/US2013/038438 dated Aug. 16, 2013.

Written opinion of the international search authority for PCT international application ser. No. PCT/US2016/029349, dated Oct. 4, 2016.

METHOD AND APPARATUS FOR INJECTING FLUID INTO SPACED INJECTION ZONES IN AN OIL/GAS WELL

CROSS-REFERENCE TO RELATED APPLICATIONS

This application is a continuation in part of U.S. application Ser. No. 15/192,787 filed Jun. 24, 2016, which is a continuation in part of U.S. application Ser. No. 14/697,289 filed Apr. 27, 2015, which is a continuation in part of U.S. application Ser. No. 13/863,063 filed Apr. 15, 2013, which is a continuation in part of U.S. application Ser. No. 13/669,059 filed Nov. 5, 2012, which claims priority from U.S. Provisional Application Ser. No. 61/639,569 filed Apr. 27, 2012. The entire contents of each mentioned application are hereby expressly incorporated herein by reference thereto.

BACKGROUND OF THE INVENTION

1. Field of the Invention

This invention relates to a tubing retrievable injection sleeve used in an oil/gas well for providing a controlled flow path for injection fluid into a selected portion of the formation surrounding a well and to apparatus and method for sequentially injecting fluid into a well. A variable orifice insert flow controller having a valve is used in conjunction with the sleeve to initially move a closure member of the sleeve to an open position by aligning ports in the sleeve and the housing of the tool while maintaining the valve closed thereby preventing injection fluid flow through the sleeve at a first pressure level.

Upon an increase in pressure the valve of the variable orifice insert flow controller will open thereby permitting full flow of fluid into the formation.

2. Description of Related Art

Currently injection sleeves for allowing fluid flow into a selected area of the formation surrounding an oil/gas well are actuated by dropping a ball of selected diameter to move a sleeve to open outlet ports.

This requires a ball dropping mechanism and is somewhat unreliable and results in the injection outlets to be in a permanently open position.

It is also known to use hydraulically actuated injection sleeves. However this technique requires extremely long control lines up to two miles in the case of a subsea system which is very costly, time consuming and may fail.

BRIEF SUMMARY OF THE INVENTION

The present invention includes a tubing retrievable injection sleeve which includes a relatively large piston that acts to move the injection sleeve to an open position as a result of initial fluid flow to the sleeve. A variable orifice insert valve located within the sleeve initially prevents fluid flow through the sleeve at a first given pressure but will open at a given second level of fluid pressure to allow flow through the sleeve.

The sliding sleeve will be fully open before any injection of fluid occurs into the formation. This results in a significant increase in the longevity of the tool and will prevent the packing around the sliding sleeve ports from having to open under pressure, which damages the seals over time. The design also eliminates any sleeve "chatter" during operation.

The variable orifice valve includes a pair of oppositely polarized magnets which together with the bi-directionality of the large annular piston seals prevent any lower well pressure from reaching the surface.

A plurality of injection sleeves may be sequentially positioned within a well so that as an uphole zone is treated and the pressure raises in the zone, the tubing pressure will actuate an injection sleeve downhole of the first injection sleeve. A variable orifice injection valve such as disclosed in application Ser. No. 14/697,289 may be positioned downhole of the injection sleeves.

DETAILED DESCRIPTION OF THE INVENTION

Figure 1:
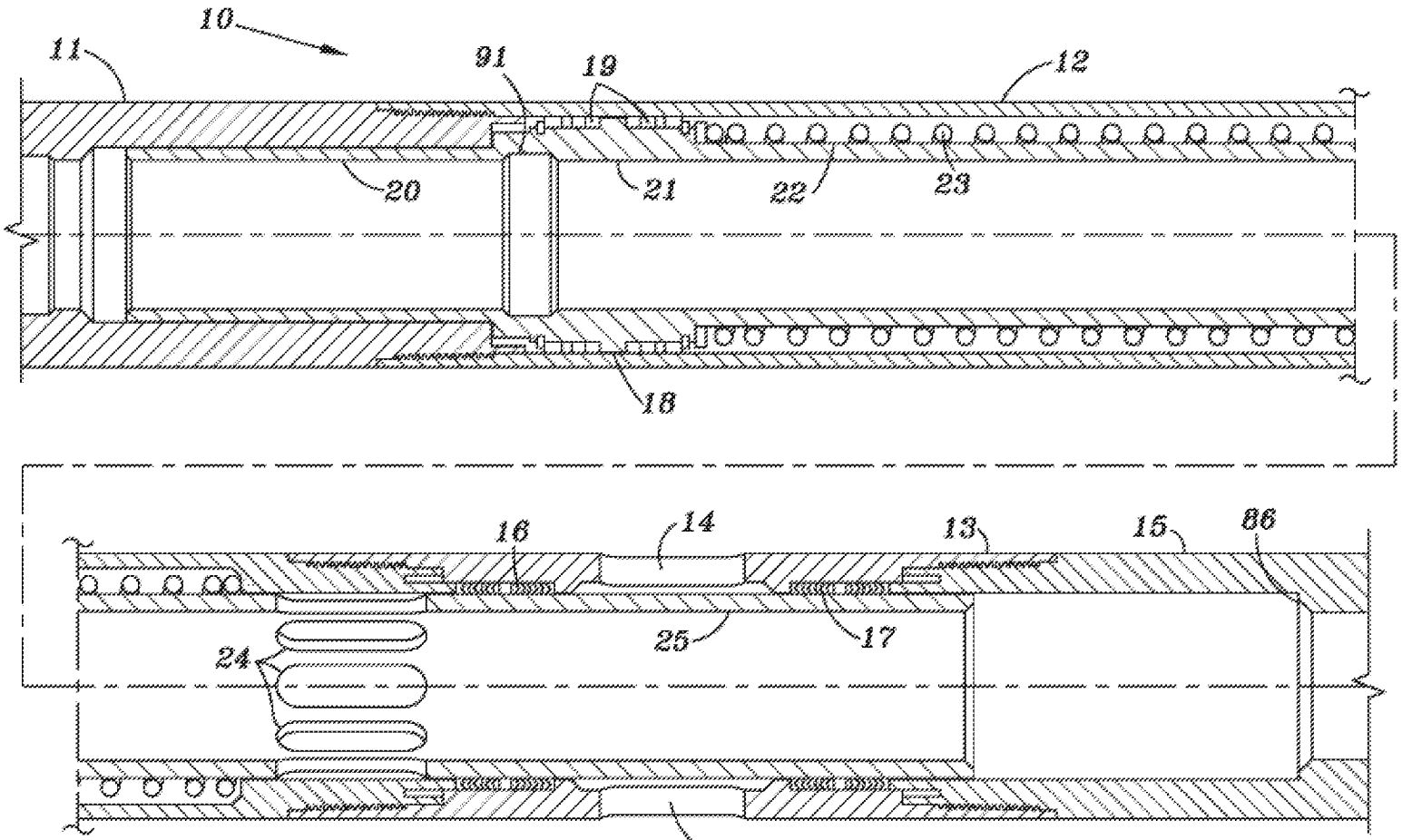
FIG. 1 is a cross-sectional view of an injection sleeve according to an embodiment of the invention.

Referring to FIG. 1, a tubing retrievable injection sleeve 10 includes a tubular outer housing which includes an uphole portion 11, mid portions 12 and 13 and a downhole portion 15. A plurality of radially spaced outlet ports 14 are provided through mid-housing portion 13.

An axially movable flow tube is positioned within the housing and includes an uphole portion 20, an enlarged annular piston 21, a mid-sleeve portion 22 and a downhole portion 25. The flow tube includes a plurality of radially spaced outlets 24 which are adapted to align with outlet ports 14 so that fluid flow may be established to the well formation adjacent outlet ports 14. Annular packing seals 16 and 17 are positioned on both sides of outlet ports 14 on the interior surface of housing portion 13 as shown in FIG. 1. A power spring 23 is positioned between housing portion 12 and flow tube portion 22.

Enlarged annular piston 21 includes a raised annular ridge 18 having seals 19 on opposite sides as shown in FIG. 1.

Figure 2:
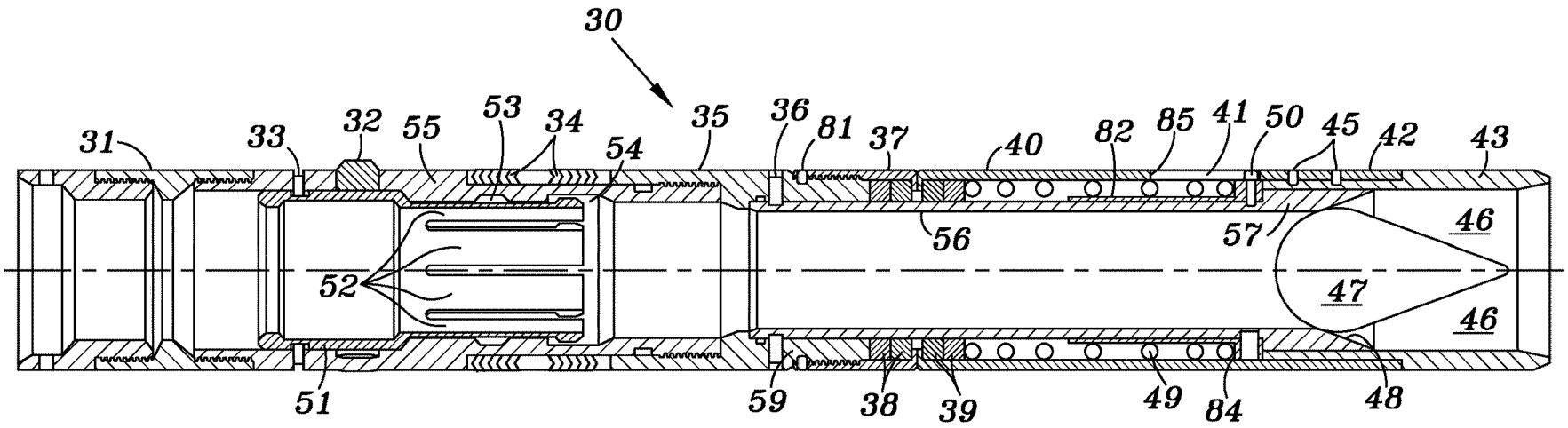
FIG. 2 is a cross-sectional view of the wireline retrievable variable orifice insert according to an embodiment of the invention. The variable orifice is closed.
Figure 3:
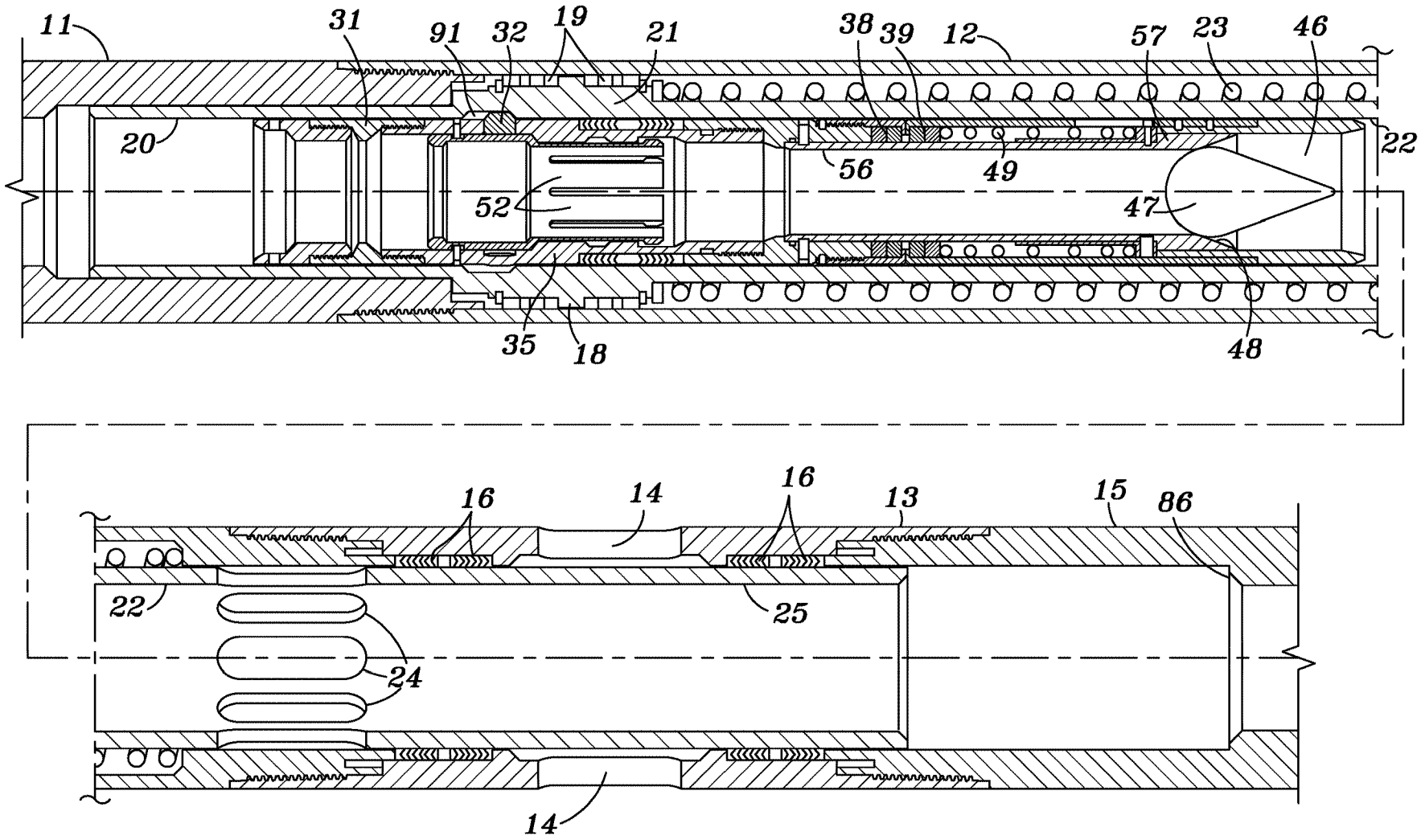
FIG. 3 is a cross-sectional view of the wireline retrievable variable orifice insert of FIG. 2 positioned within the injection sleeve of FIG. 1 in a no flow condition. The variable orifice is closed.

FIG. 2 illustrates an embodiment of a variable orifice insert 30 that in use is placed within the injection sleeve of FIG. 1 as shown in FIG. 3 which will be described in more detail below.

Variable orifice insert 30 includes an uphole connector 31 and a collet housing 55. A connector sub 35 is connected to collet housing 55 at one end and to a fixed flow tube 56 via pins 36 at a second end 59. A collet having fingers 52 is positioned within collet housing 55 which includes two axially spaced annular grooves 53 and 54 as shown in FIG. 2. A plurality of pins 33 hold collet 51 within collet housing 55. A plurality of locking dogs 32 extend through collet housing 55 in a known manner. A pair of seals 34 are mounted on collet housing 55.

A mid housing portion 37 is also connected to connector sub 35 by threads 81. A first pair of magnets 38 are fixed on flow tube 56 while a second pair of magnets 39 of opposite polarity are mounted for sliding movement with an annular outer sleeve member 40 along flow tube 56. Outer sleeve member includes a J slot 41 shown in FIGS. 6-9. An annular spring bearing 82 is fixed to flow tube 56 and a guide pin 50 which is secured to flow tube 56 extends through slot 41. An enlarged portion 57 of the flow tube includes a valve seat 48 which cooperates with valve body 47 to form a valve.

A terminal outlet member 43 is connected via pins 45 to outer sleeve member 40. Valve body member 47 is fixed to terminal outlet member 43 by one or more struts 46. A coil spring 49 is positioned between flow tube 56 and outer sleeve member 40. The spring 49 is positioned between magnet pair 39 and a fixed shoulder 84 on spring bearing 82 which is fixed to flow tube 56.

As can be appreciated by the forgoing description, outer sleeve member 40, terminal outlet member 43, magnets 39 and valve body 47 are configured to slide axially to the right looking at FIG. 2 on flow tube 56 thereby moving valve body 47 off valve seat 48. In this position fluid flow is permitted through flow tube 56.

FIG. 3 illustrates the variable orifice insert 30 positioned within the injection sleeve 10 in a no flow condition with the uphole pressure differential unable to compress spring 23. The outlets 24 of downhole portion 25 of the injection sleeve are not in alignment with outlet ports 14 of the outer housing portion 13. Valve body 47 is seated against valve seat 48. The variable orifice insert can be wireline deployed into the well in a bypass mode as explained below. Locking dogs 32 are positioned within an annular groove 91 formed in flow tube portion 20.

Figure 4:
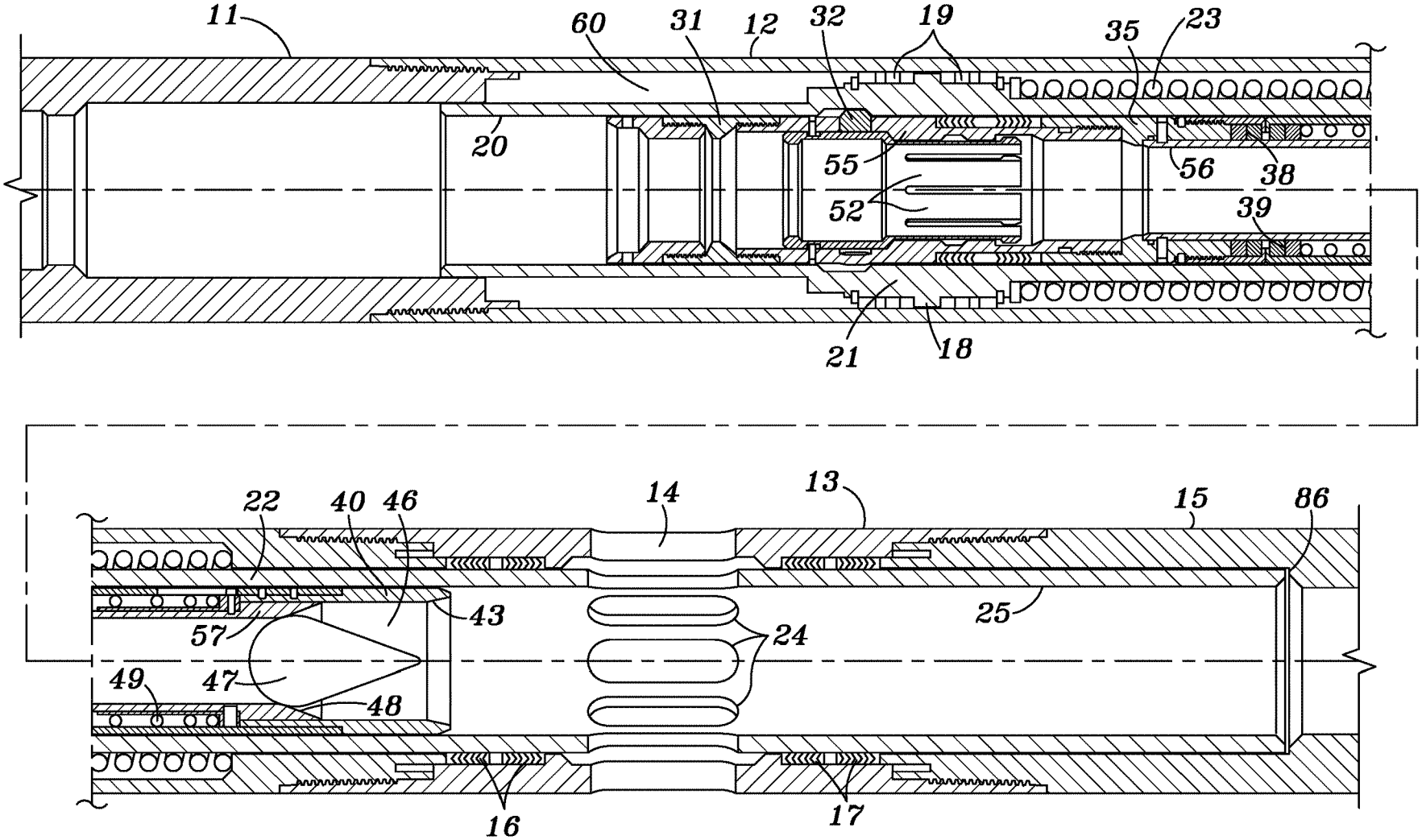
FIG. 4 is a cross-sectional view of the wireline retrievable variable orifice insert and injection sleeve with the sliding sleeve ports in an open position. The variable orifice is closed.

In the position shown in FIG. 4, fluid is introduced at a first pressure into the tool and internal pressure above the variable orifice insert acts on enlarged piston 21 by virtue of a clearance between housing 11 and flow tube portion 20 to move to the right as shown in FIG. 4. This causes outlets 24 in flow tube portion 25 to come into registry with outlet ports 14 in the housing and variable orifice insert 30 is moved along with piston 21 by virtue of locking dogs 32. However, at this point valve body 47 is in a closed position on valve seat 48 so that no flow occur through the variable orifice insert. Movement of the piston 21 will cause power spring 23 to compress. Axially movement of sleeve 25 is limited by a stop shoulder 86 provided in housing portion 15.

Figure 5:
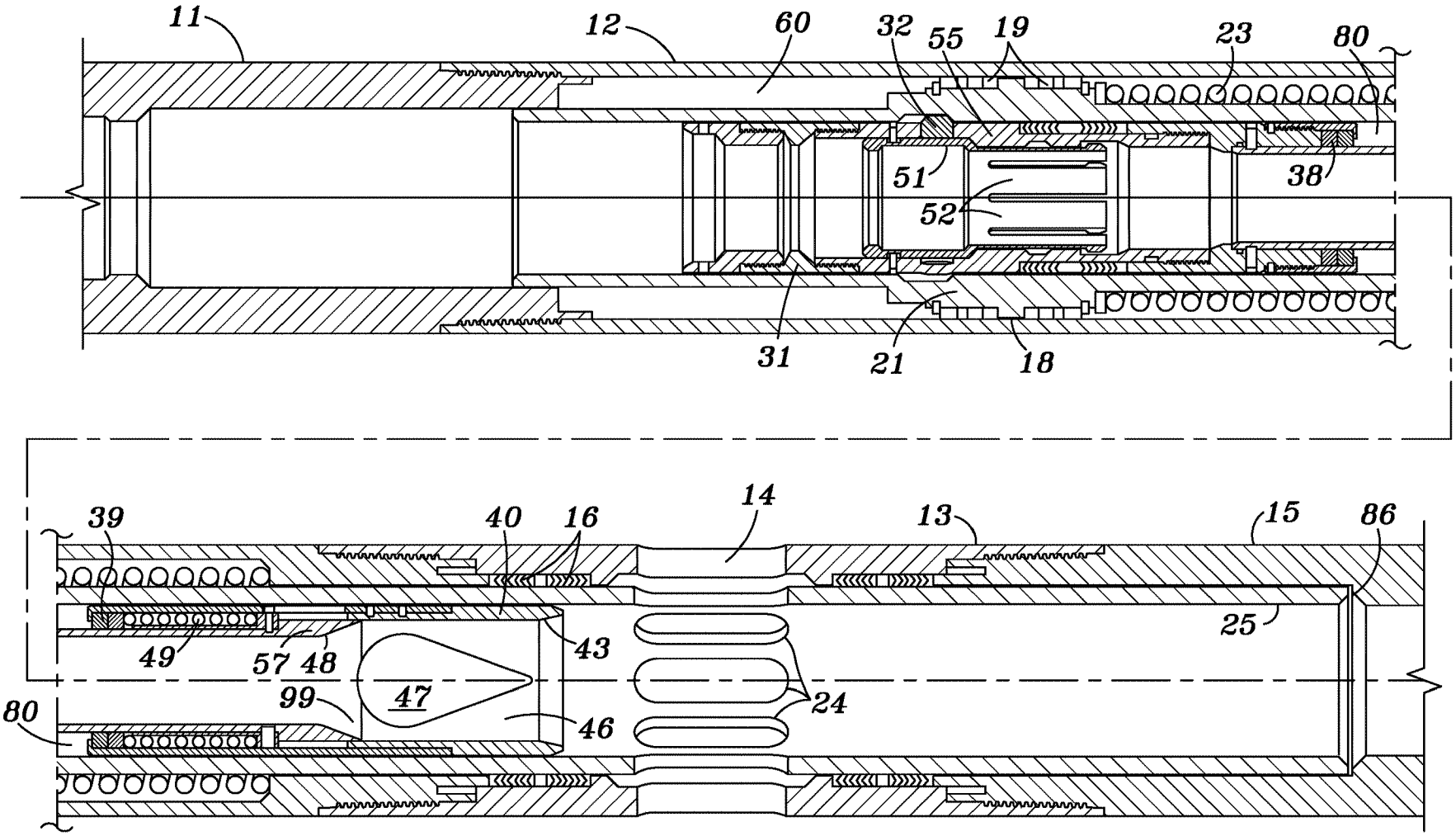
FIG. 5 is a cross-sectional view of the wireline retrievable variable orifice insert and the injection sleeve in a fully open portion for injection. The variable orifice is in a fully open position.

As the flow rate of injection fluid is increased, it will be sufficient to axially move outer sleeve member 40, terminal outlet member 43, magnets 39 and valve body 47 to the right as shown in FIG. 5, thereby forming a variable orifice 99. This movement is resisted by the compression of spring 49 and the attraction force between magnet pairs 38 and 39. The tool is now in the full flow condition.

Termination of injection fluid flow will cause the tool to revert back to the no flow condition shown in FIG. 3 by the return force of compressed power spring 23 and the attractive force between magnets 38 and 39.

Figure 6:
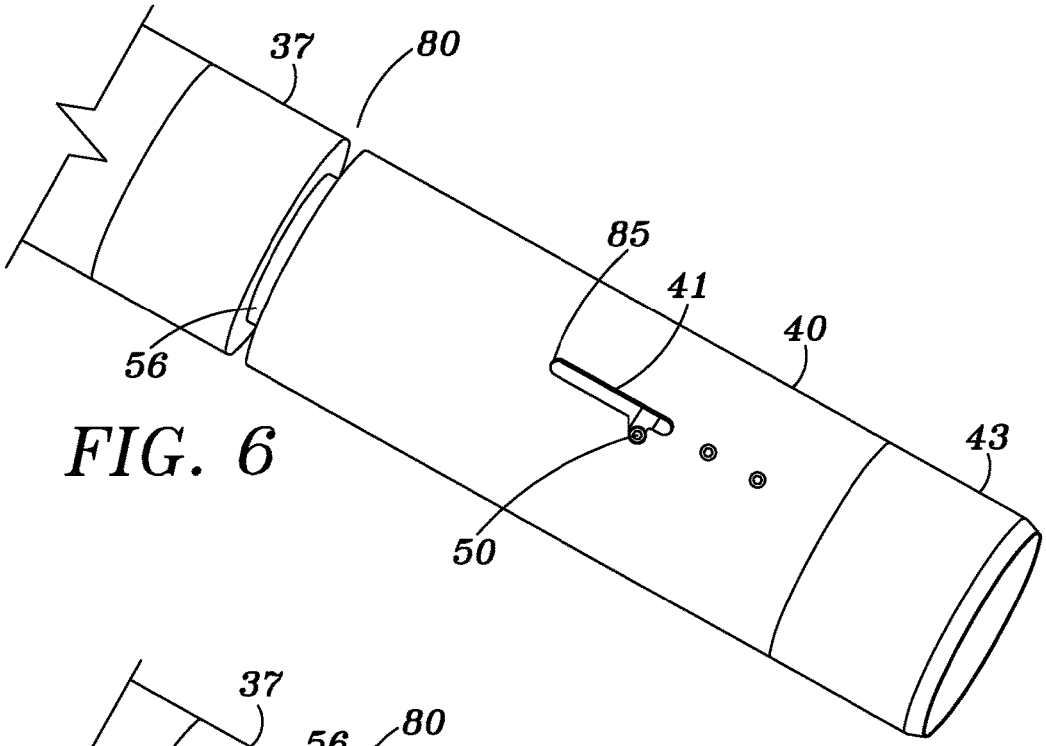
FIG. 6 is a showing of the portion of the terminal outlet sleeve of the variable orifice insert with a "J-slot" in the run-in condition locked in an open position.

FIG. 6 illustrates the position of pin 50 within slot 41 of the outer sleeve member 40 during the run-in condition. The variable orifice insert valve is slightly open to allow fluid in the well to escape to the well head.

Figure 7:
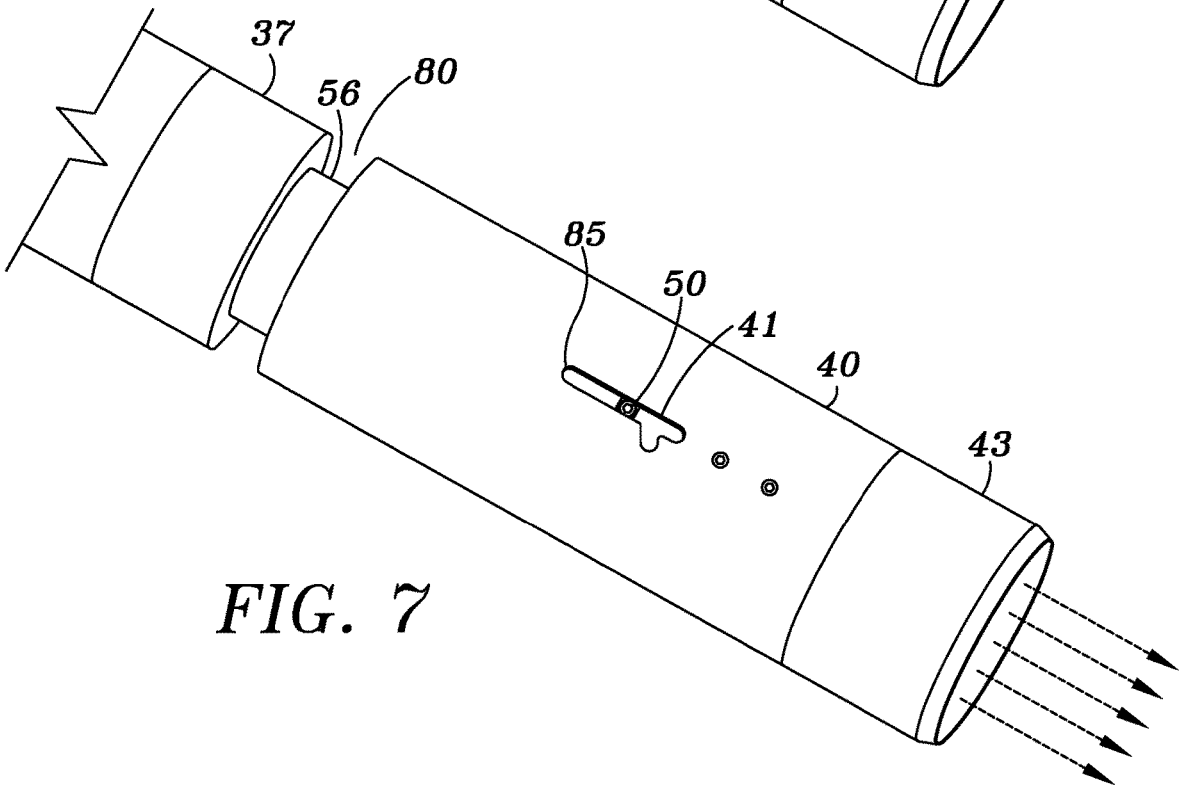
FIG. 7 is a showing of the position of the terminal outlet sleeve unlocked at a first flow rate free to open or close.
Figure 8:
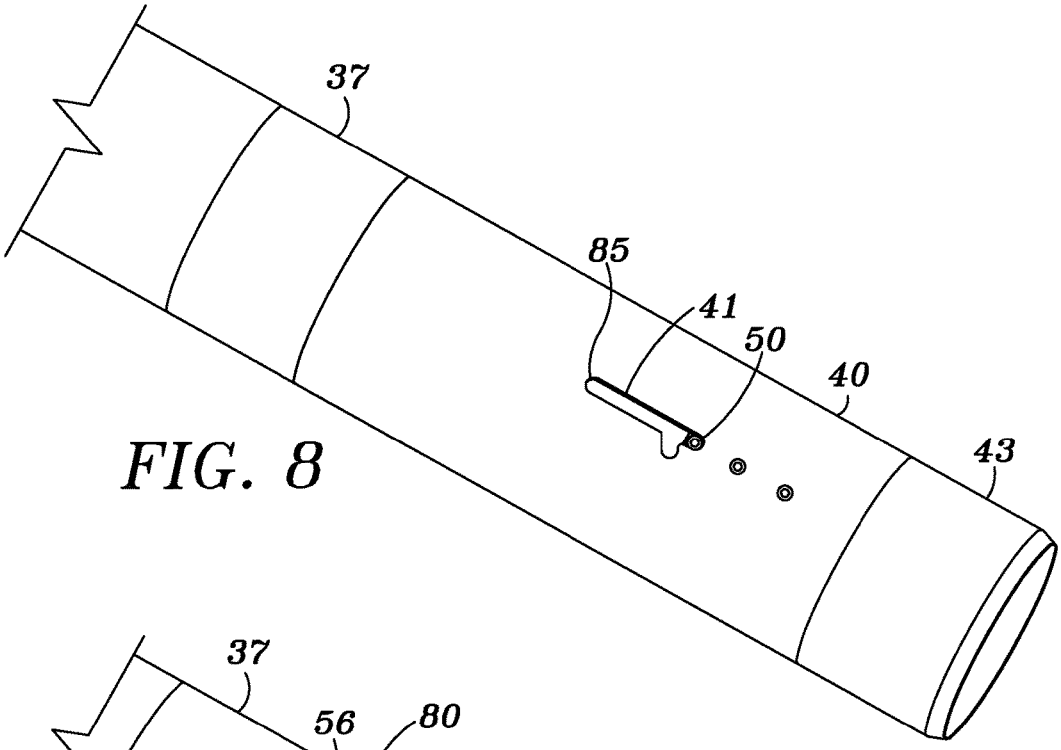
FIG. 8 is a showing of the portion of the terminal outlet sleeve at the reset or closed position.

FIG. 7 illustrates the resetting position of the variable orifice insert wherein the pin 50 is positioned within slot 41 as shown. This allows the terminal outlet member 43 to reposition to the position shown in FIGS. 2 and 8 which is a fully closed position.

Figure 9:
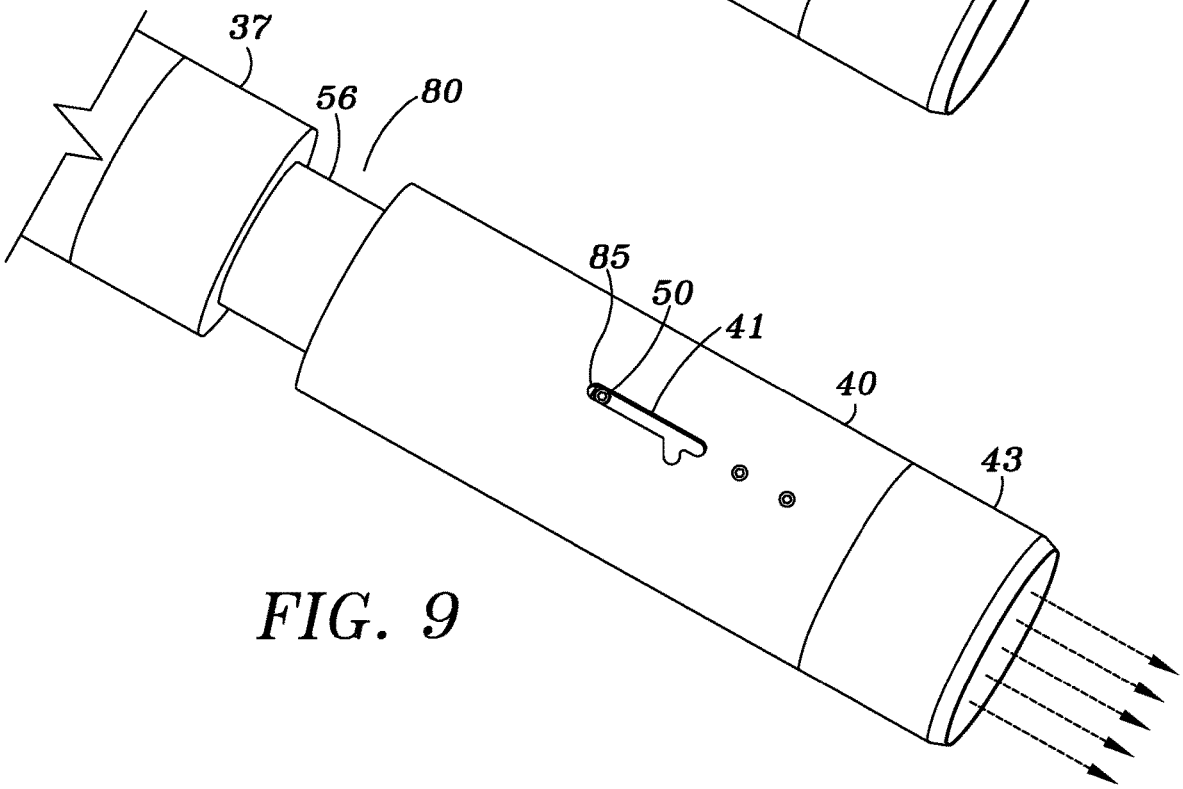
FIG. 9 is a showing of the position of the terminal outlet sleeve in a full flow condition.

In the full flow position shown in FIGS. 9 and 5, pin 50 abuts against end position 85 of slot 41 and the outer sleeve member 40 and terminal outlet member 43 are spaced by gap 80 from mid-housing portion 37.

With the tool positioned within the well and upon initial fluid flow, outlet ports 14 and outlets 24 will initially be moved into registry without fluid flow through the tool. This prevents the packing seals 16 and 17 around outlet ports 14 from being subjected to high pressure prior to opening which damages the seals over time.

Figure 10:
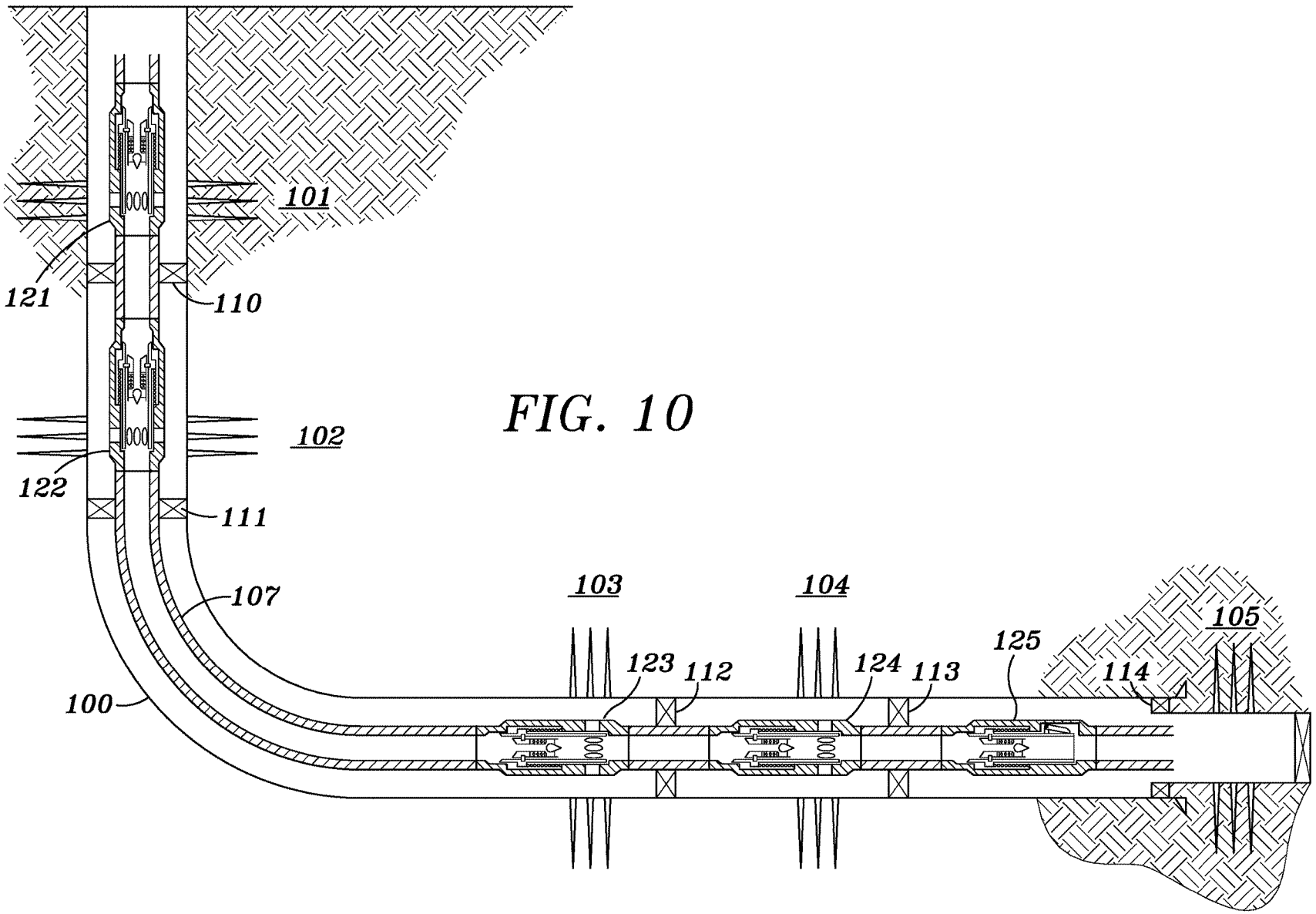
FIG. 10 is a schematic showing of sequential injection along several formation zones of an oil/gas well.

FIG. 10 represents a schematic showing a multiple staged injection system for a well. Injection sleeves 121, 122, 123, and 124 according to the invention are positioned along tubular string 107 within well 100. Packers 110, 111, 112, 113, and 114 are located within the well thus forming injection zones 101, 102, 103, 104, and 105.

An injection valve 125 which may be of the type disclosed in application Ser. No. 14/697,289 filed Apr. 27, 2015, the entire contents of which is hereby incorporated herein by reference thereto, is positioned in the tubular string 100.

As injection fluid is first introduced into tubular string 107, injection sleeve will initially operate to align ports 24 with outlet ports 14. Additional pressure will cause valve body 47 to move off valve seat 48 thereby allowing injection fluid to flow into injection zone 101. As flow continues into zone 101, pressure within the zone will increase to a point where pressure within tubular string 107 will actuate the second injection sleeve to allow injection fluid flow into zone 102. This will continue until injection valve 125 is opened and the last zone 105 is treated. When injection fluid flow is terminated the injection sleeves will act as a dual barrier valve which will prohibit fluid flow from the formation zones 101-105 back to the surface of the well.

In operation, when multiple zones are exposed to the well, it may be desirable to enable the injection into one zone over another or others. The ability to select and prioritize injection into one zone over a second, or subsequent zones are possible using the present invention. The power springs 23 or the coil springs 49 in injection sleeves 121-124 and/or the power springs 570 or coil springs 507 in the in the variable orifice injection valve 125 may be made stronger or weaker so as to vary the pressure at which each opens, thereby allowing the operator to "select" the order in which ports are opened to control the direction of injection flow by varying the force or pressure required to open. Also, greater or fewer numbers of magnets 38 and 39 may be used to accomplish the same end. The magnets 38, 39 may also be omitted from this method and still be within the scope and spirit of the present invention In operation, the combination of using a variable orifice injection valve and variable orifice injection sleeves serves to selectively allow injection into a plurality of zones, which all may have different pressure, and simultaneously prevent back flow from the formation and/or cross flow between formations. The variable insert may be retrieved by wireline by inserting a suitable pulling tool into connector 31.

At low flow rates, the valve in the variable orifice insert will crack open when the pressure exerted on the valve body 47 overcomes the spring force plus friction. As flow increases, the orifice area 99 opens to further accommodate the additional rate. When flow rate decreases, the orifice closes to accommodate the flow decreases. Because of the interaction of the spring and the magnets, the pressure drop (or delta –P) across the orifice is relatively constant even as flow rates change up or down.

Although the present invention has been described with respect to specific details, it is not intended that such details should be regarded as limitations on the scope of the invention, except to the extent that they are included in the accompanying claims.

What is claimed is:

1. An apparatus for sequentially injecting fluid into a plurality of formation zones of a well comprising:

a tubular string;

a plurality of injection sleeves positioned at spaced locations in the tubular string, wherein each injection sleeve includes a housing and an axially movable flow tube adapted to provide fluid communication to the formation injection zones, each injection sleeve includes a variable orifice insert positioned within the axially movable flow tube and having a valve which is adapted to remain closed at a first pressure level, and each flow tube includes a piston portion and a first spring positioned between the piston and a shoulder provided on the housing, and a second spring for basing the valve of the variable orifice insert to a closed position.

2. The apparatus of claim 1, wherein the strengths of the first and second springs are chosen so that at a first selected pressure, the flow tube will be moved to a position opening outlet ports in the housing while flow through the sleeve is prevented by the variable orifice insert.

3. The apparatus of claim 2 wherein the valve in the variable orifice insert is subsequently opened at a second pressure level higher than the first selected pressure level.

* * * * *